United States Patent [19]

Alia et al.

[11] Patent Number: 4,689,630

[45] Date of Patent: Aug. 25, 1987

[54] MULTI-SHAPED-BEAM REFLECTOR ANTENNA

[75] Inventors: Francesco Alia; Gianfranco Ruggerini, both of Rome, Italy

[73] Assignee: Contraves Italiana S.p.A., Italy

[21] Appl. No.: 622,225

[22] Filed: Jun. 19, 1984

[30] Foreign Application Priority Data

Jun. 23, 1983 [IT] Italy ..... 21753 A/83

[51] Int. Cl.[4] ..... H01Q 13/02; H01Q 19/13

[52] U.S. Cl. ..... 343/779; 343/786

[58] Field of Search ..... 343/779, 783, 785, 786, 343/776, 777, 781 R

[56] References Cited

U.S. PATENT DOCUMENTS

| | | | |
|---|---|---|---|
| 2,472,201 | 6/1949 | Eyges | 343/786 |
| 2,530,079 | 11/1950 | Riblet | 343/779 |
| 2,692,336 | 10/1954 | Kock | 343/786 |
| 3,508,276 | 4/1970 | Rope et al. | 343/785 |
| 3,701,160 | 10/1972 | Beguin | 343/786 |
| 3,854,141 | 12/1974 | Smith | 343/777 |
| 4,419,670 | 12/1983 | Hill | 343/779 |

FOREIGN PATENT DOCUMENTS

| | | | |
|---|---|---|---|
| 1904130 | 7/1970 | Fed. Rep. of Germany | 343/786 |
| 24561 | 2/1979 | Japan | 343/786 |

OTHER PUBLICATIONS

Reindel, "The H-Guide . . .", Sylvania Electric Products, Inc., Electronic Defense Laboratories Technical Memorandum, No. EDL-M377, Aug. 11, 1961, Cover Page and p. 21.

*Primary Examiner*—William L. Sikes
*Assistant Examiner*—Michael C. Wimer
*Attorney, Agent, or Firm*—Amster, Rothstein & Ebenstein

[57] ABSTRACT

A reflector antenna is disclosed which generates two or more beams which are separated angularly in the elevation plane, as in multi-beam antennas, and are shaped so as to provide, when combined, any desired pattern of coverage. The antenna includes a horn which receives separated inputs and radiates toward a reflector primary beams displaced from one another by a predetermined angle but having a single phase center.

1 Claim, 6 Drawing Figures

MULTI-SHAPED-BEAM REFLECTOR ANTENNA

The present invention relates to reflector antennas, particularly for use in radar systems.

A basic problem in the field of search radars is to optimize the radiation pattern of the antenna to obtain the maximum possible coverage volume and the desired shape of the coverage pattern.

These antennas have very often a single shaped beam. Reflector antennas are generally used for this purpose.

In order to increase the radar coverage volume and simultaneously obtain additional information on the detected target (for example, an indication of angle of elevation data of the target) multi-beam antennas and beam scanning antennas have been adopted.

The multi-beam antennas have, in the elevation plane, a certain number of beams which all have the same shape and are disposed in discrete angular sectors so as to reduce the overlapping areas to a minimum. These beams receive, either simultaneously or sequentially, the power reflected by the various targets which are present in the search volume and are illuminated by the radar. The multi-beam antennas, in addition, are generally obtained by means of an array of radiating elements which are excited by a complex network characterized by a number of ports equal to the number of beams.

These antennas are rather sophisticated and expensive and are not used in small radar systems. On the other hand, the pattern of the total coverage is very similar to a sector, whereas, for short range defense systems, the pattern of the desired radar coverage is shaped and very often of the type $\text{cosec}^2$ so as to assure a constant coverage at any altitude.

It has been also suggested to use for search radars shaped-beam reflector antennas having two or more beams which are originated either by arranging a plurality of feeders in different positions and feeding them by switching or by using a vertical feeder array with combined feedings. In these applications, the beams, besides having roughly the same shape, are not separated angularly. Therefore, they lack the basic advantages of multi-beam antennas.

It is the object of the present invention to provide a reflector antenna with two or more shaped and separated beams so as to obtain the advantages of multi-beam antennas, the adaptability of total coverage to desired shape and the economy of reflector antennas.

More particularly, the reflector antenna according to the invention is characterized in that it comprises a feeder with two or more primary beams having a single phase center but angularly displaced from one another and a reflector designed to convert the primary beams to secondary beams which are differently shaped and angularly displaced from one another.

The invention will be better understood from the following description, given merely by way of example and therefore not in a limiting sense, of an embodiment thereof, by reference to the accompanying drawings in which.

The study of single-shaped-beam reflector antennas always starts with the synthesis of the central section of the reflector. The latter determines namely the shape of the radiation pattern in the vertical plane of the antenna both for cylindrical and double curvature reflectors.

Figure 1:
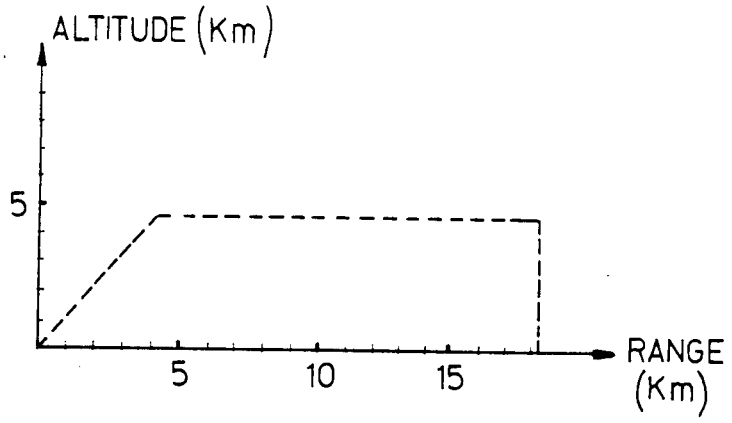
FIG. 1 is a graph showing a radar coverage pattern which it is desired to obtain by means of the antenna according to the invention.

This synthesis, which is now well known, is based on principles of geometric optics, and seeks to obtain a coverage pattern, for example, like that shown in FIG. 1, by suitably deviating the electromagnetic energy rays originated by the feeder. The latter, independently of its structure (horn, mini-array, screen dipole, . . . ) always has a radiation pattern of the type shown in FIG. 2.

Figure 3:
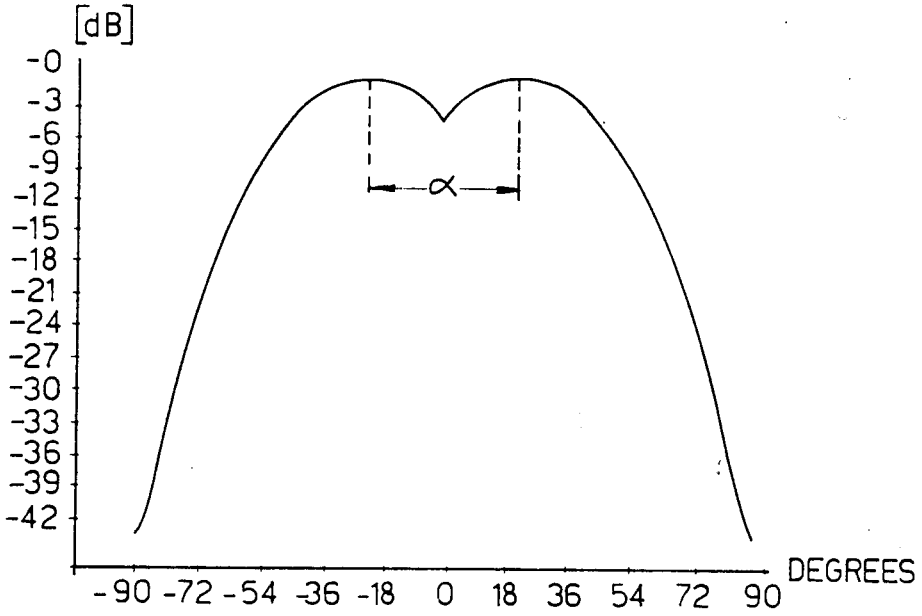
FIG. 3 is a graph showing a primary radiation pattern used in the synthesis for an antenna according to the invention comprising two beams.
Figure 4:
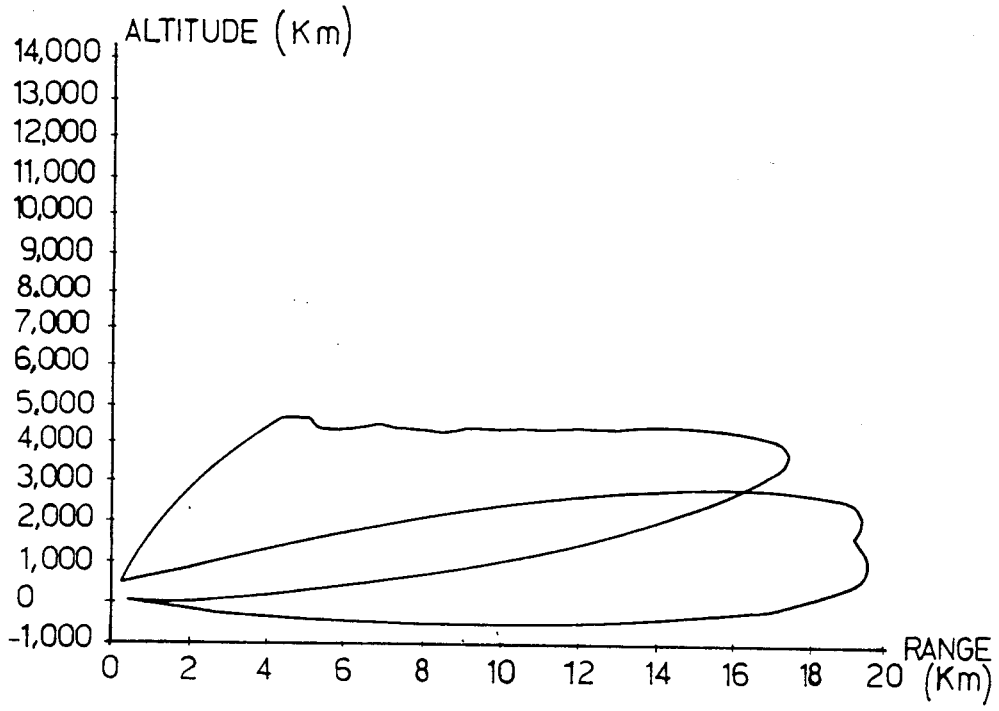
FIG. 4 is a graph showing two obtainable coverage patterns having a complementary shape with respect to the pattern of FIG. 1.

The synthesis method for the reflector according to the present invention uses a primary field with a plurality of angularly separated maxima as shown in FIG. 3 for the case of a two-beam antenna.

Figure 2:
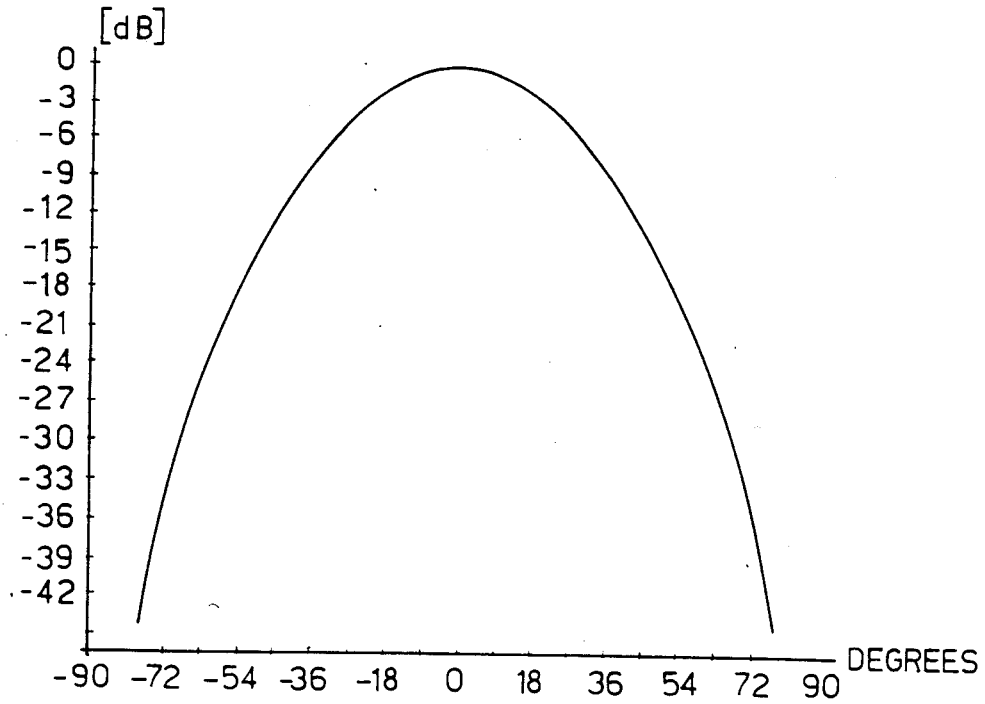
FIG. 2 is a graph showing the typical radiation pattern of a feeder.

The two shaped beams are obtained by illuminating the reflector by means of two discrete primary fields which have the same shape but are deviated from one another by an angle corresponding to the distance between the two maxima of the curves of FIG. 2. Synthesis includes selection of the value of this angle, which is critical; in fact, values which are too small lead to the generation of overlapped secondary beams, and values which are too high increase the height of the reflector without substantially modifying the shape of the beams.

It has been found that the synthesis method used according to the invention brings about best results when the illumination function is derived from the radiation patterns of conventional horn feeders.

In accordance with the invention, a horn has been constructed and tested having two inputs which are sufficiently isolated from one another (at least 20 dB isolation) and are positioned to originate two beams having identical shapes but deviated from one another by the angle $\alpha$ indicated in FIG. 3.

Figure 5:
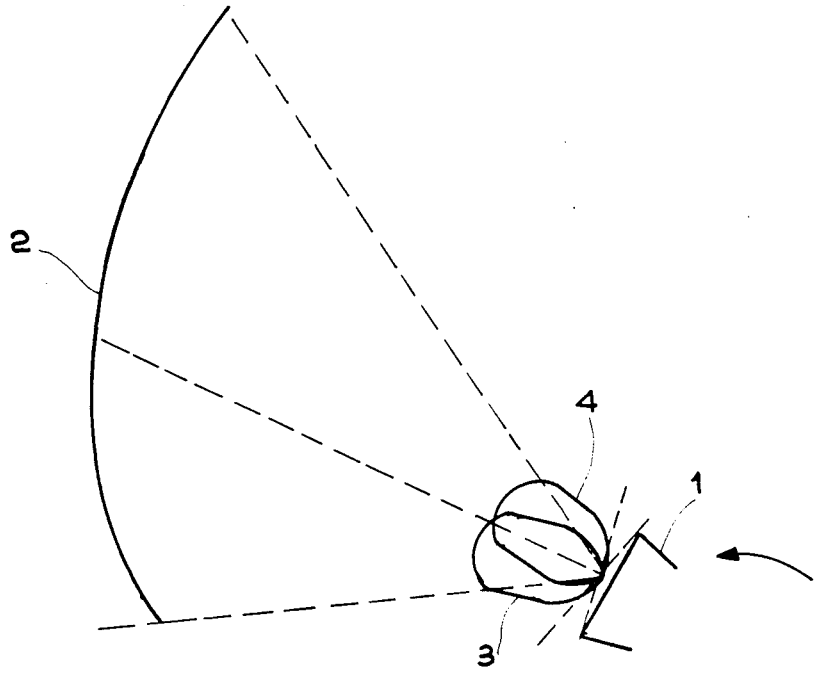
FIG. 5 is a diagramatic view of an antenna according to the invention adapted to provide coverage patterns as those of FIG. 4.
Figure 6:
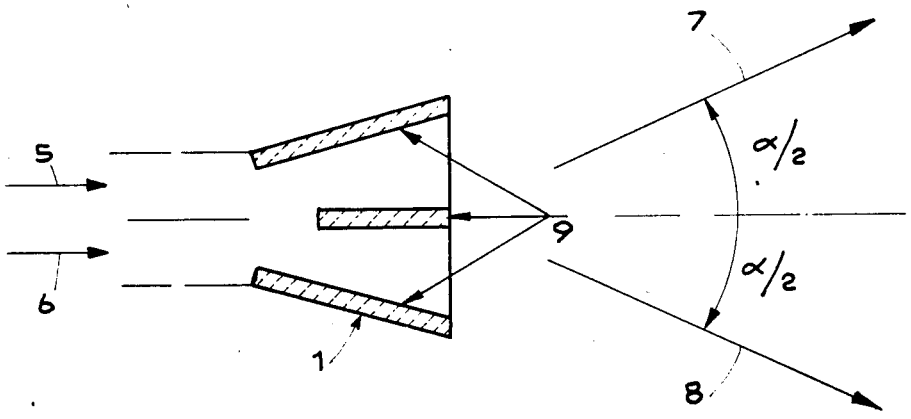
FIG. 6 is a diagramatic view of a feeder structure adapted to be used in the antenna of FIG. 5.

In FIG. 5 there is shown diagrammatically such an antenna which comprises a horn 1 having two separated inputs which radiates towards a reflector 2 two primary beams 3 and 4. The horn 1 is shown in greater detail in FIG. 6. It it seen that it comprises two inputs 5, 6 to each of which corresponds a beam whose direction (7 and 8 respectively) is deviated with respect to the mouth of the horn, by dielectrics 9 which are parallel to the direction of the electric field which make possible control of the various propagation modes originating in the horn almost independently of each other so as to optimize the radiation pattern of the two beams.

The symmetry of the feeder with respect to its horizontal plane provides symmetry in behavior of the two beams.

The antenna according to the invention enables the vertical height of the reflector to be reduced, and as compared with a reflector designed to obtain total coverage by means of a single shaped beam, is only 20% higher. Also, the antenna according to the invention is constructionally simple as compared to the type of antennas now used to provide the performance described above. In the description, given by way of example, of an embodiment of the invention, it has been assumed that the reflector is of the double curvature type. The invention, however, is not limited to the use of this type of reflector but can be put into practice also with cylindrical reflectors or lens structures.

Generally, while only one embodiment of the invention has been illustrated and described, it is obvious that a number of changes and modifications can be made without departing from the scope of the invention.

We claim:

1. A reflector antenna comprising a feeding system including a horn antenna with two separate input systems producing two primary beams radiating toward a reflector and having a common phase center but physically angularly displaced from one another, and said horn antenna further having baffle including dielectric material for controlling the propagation of modes, and said reflector interacting with the primary beams to produce two secondary beams angularly displaced from one another.

* * * * *